US005860200A

United States Patent [19]

Wells et al.

[11] Patent Number: 5,860,200

[45] Date of Patent: Jan. 19, 1999

[54] MATTRESS COVER SECUREMENT APPARATUS

[75] Inventors: Thomas J. Wells, Carthage; Robert C. Starr, IV, Granby, both of Mo.

[73] Assignee: L&P Property Management Company, South Gate, Calif.

[21] Appl. No.: 781,031

[22] Filed: Jan. 8, 1997

Related U.S. Application Data

[62] Division of Ser. No. 567,842, Dec. 6, 1995, Pat. No. 5,615,435.

[51] Int. Cl.[6] ..... F16B 19/00

[52] U.S. Cl. ..... 24/703.1; 24/703.3; 24/703.5; 5/716

[58] Field of Search ..... 24/703.1, 703.2, 24/703.3, 703.4, 703.5, 703.6, 704.1, 30.5 T, 30.5 S, 23, 25, 33 B; 5/716

[56] References Cited

U.S. PATENT DOCUMENTS

| | | | |
|---|---|---|---|
| 0,903,756 | 11/1908 | McGill | 24/703.3 |
| 1,182,276 | 5/1916 | Jacobs et al. . | |
| 1,594,691 | 8/1926 | Purple | 24/33 B |
| 1,653,624 | 12/1927 | Gingras | 24/33 B |
| 2,107,446 | 2/1938 | Koliba . | |
| 2,180,500 | 11/1939 | Bernstein | 24/703.5 |
| 2,358,490 | 9/1944 | Uribe | 24/703.4 |
| 2,766,816 | 10/1956 | Koenigsberg . | |
| 4,648,158 | 3/1987 | West | 24/23 W |
| 4,724,590 | 2/1988 | Langas et al. . | |
| 4,829,643 | 5/1989 | Ayres et al. . | |
| 4,866,971 | 9/1989 | Coccagna | 24/703.1 |
| 5,314,064 | 5/1994 | Wells et al. . | |

FOREIGN PATENT DOCUMENTS

| | | | |
|---|---|---|---|
| 0021085 | 11/1902 | United Kingdom | 24/33 B |

*Primary Examiner*—Victor N. Sakran
*Attorney, Agent, or Firm*—Wood, Herron & Evans, L.L.P.

[57] ABSTRACT

An apparatus and method for securing a top panel cover of a mattress to an innerspring core include a plurality of clips attached to an upper border wire of the core. Each clip has one or more barbs that project inwardly with respect to the core. The cover is attached to the core by stretching and wrapping the edges of the cover over and around the border wire and pushing the edges against the barbs so that the barbs pierce the edges and hold the edges in a taut position at least partially wrapped around the border wire.

9 Claims, 2 Drawing Sheets

MATTRESS COVER SECUREMENT APPARATUS

This application is a divisional of application Ser. No. 08/567,842, filed Dec. 6, 1995, now U.S. Pat. No. 5,615,435.

FIELD OF THE INVENTION

This invention relates to bedding products. More particularly, this invention relates to the attachment of a top panel cover to an innerspring core of a mattress or box-spring.

BACKGROUND OF THE INVENTION

Typically, a mattress is composed of a spring assembly or innerspring core covered by a fabric or textile covering. The innerspring core usually has a plurality of coil springs arranged in rows between upper and lower border wires, with the endmost coil springs in each row being joined to the upper and lower border wires by means of sheet metal clips. The top panel of the mattress cover is then affixed to the upper border wire by wrapping the edges of the cover around the upper border wire and then securing the edges in position by means of stitching, gluing, or securing with staples or hog rings.

These conventional methods of securing the top mattress cover to the innerspring core are generally manual operations. Consequently, a significant degree of nonuniformity in the end product inevitably results. Furthermore, these largely manual methods entail significant substantial labor as well as material costs.

It has therefore been an object of the present invention to provide an apparatus and method of attaching top mattress covers to innerspring cores so as to facilitate automation or at least reduction in the manual labor of the process, thereby reducing the cost and nonuniformity in the end product.

It has been a further object of the present invention to provide an apparatus and method for attaching mattress covers to innerspring cores so as to eliminate the need for hog rings or glue and thereby reduce the material costs incurred.

SUMMARY OF THE INVENTION

These and other objects of the invention are achieved by an improved means of securing a mattress cover to an innerspring core. A mattress incorporating the present invention includes an innerspring core having generally planar top and bottom surfaces, a border wire surrounding the top surface, a mattress cover located atop the top surface, and a plurality of clips attached to the border wire. Each of the clips has a barb that in an open position projects generally inwardly with respect to the mattress core and away from the border wire. The mattress cover is secured to the border wire by stretching and wrapping the edges of the mattress cover over and around the border wire, then hooking the edges of the mattress cover onto the barbs of the clips so that the barbs at least partially pierce the mattress cover and hold the edges of the mattress cover in a taut position at least partially wrapped around the border wire. The barbs may be left in open position, or they may be bent, after attachment of the edge of the cover, into a closed position such that the edge is sandwiched between the barbs and the border wire.

The clips may be stamped out of sheet metal with the barbs being integrally formed portions of the clips. These sheet metal type clips are attached to the border wire by bending the clips around the border wire and clamping them onto the border wire.

Alternatively, the clips may be made of lengths of wire bent to clip onto the border wire, with one or both ends of each length of wire shaped so as to project generally inwardly and away from the border wire, the ends thereby serving as the barbs to which the edges of the cover are attached.

The sheet metal type of clip may serve both to secure a coil spring to the border wire and to provide one or more barbs to which an edge of the cover is attached. Alternatively, some or all of the sheet metal clips may serve solely to provide barbs for attachment of the cover to the border wire without serving to secure the coil springs to the border wire. A combination of sheet metal type and wire type clips may be used.

A sheet metal clip according to the present invention comprises a generally U-shaped member having an arcuate crown portion and spaced generally parallel leg portions depending from the crown portion. In one embodiment of the clip, the leg portions include a single-prong portion and an opposing dual-prong portion. When the clip is clamped around a border wire, the single-prong portion fits between dual prongs of the opposing dual-prong portion. One prong of the dual-prong portion is left unclamped and thereby serves as a barb for attachment of a top cover.

In an alternative embodiment of a sheet metal clip, the leg portions include a single-prong portion and an opposing triple-prong portion. When the clip is clamped around a border wire, the single-prong portion fits between two adjacent prongs of the opposing triple-prong portion. One prong of the triple-prong portion is left unclamped and thereby serves as a barb for attachment of a top cover.

With either embodiment of the sheet metal clip, once the edge of the top cover has been attached to the barb, the barb is preferably clamped down onto the border wire to aid in keeping the edge secured in a taut position at least partially wrapped around the border wire. Similarly, the barbs of the wire type of clip preferably are bent down onto the border wire after attachment of the edge of the top cover.

BRIEF DESCRIPTION OF THE DRAWINGS

The objects, features, and advantages of the present invention will be better understood by reference to the following detailed description of the preferred embodiments taken in conjunction with the accompanying drawings, in which.

DESCRIPTION OF THE PREFERRED EMBODIMENTS

Figure 1:
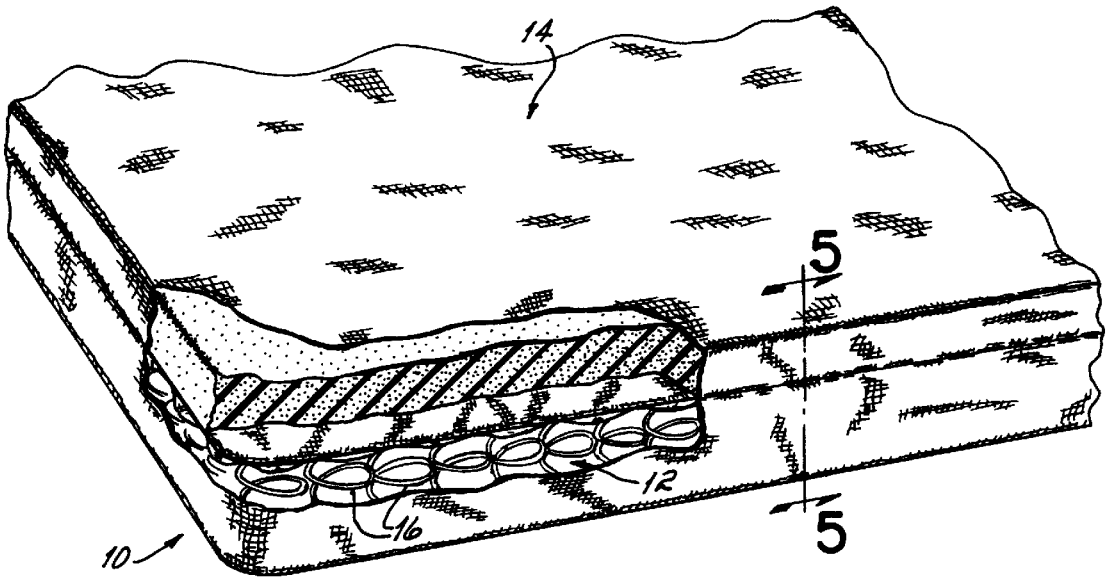
FIG. 1 is a partially cut-away perspective view of a mattress showing the internal construction of the mattress core.

As shown in FIG. 1, a mattress 10 includes a top cover 14, and an innerspring core 12 having a plurality of rows of coil springs 16.

Figure 4:
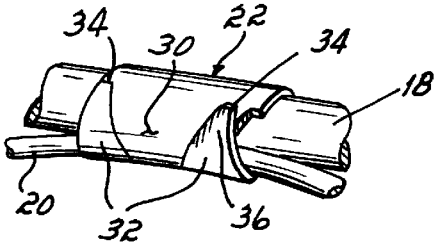
FIG. 4 is a partial perspective view of a dual-prong sheet metal clip attached to a border wire and coil spring, showing one of the prongs of the dual-prong leg portion left in an open, unclamped position so as to serve as a barb.
Figure 5:
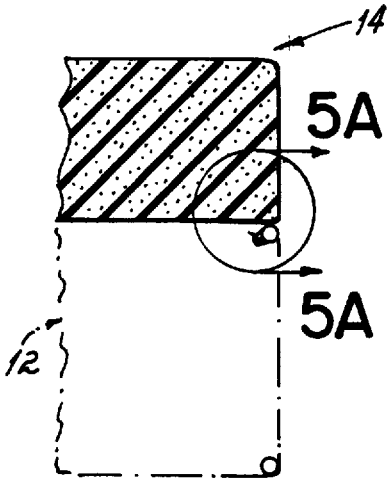
FIG. 5 is a cross-sectional view taken along the line 5—5 of FIG. 1, showing a top cover attached to an innerspring core of a mattress.

With reference to FIG. 5, the innerspring core 12 includes an upper border wire 18. In each row of coil springs 16, the endmost coil spring 16 has an uppermost coil revolution 20 attached to the upper border wire 18 by means of a sheet metal clip 22, as shown in FIG. 4.

Figure 2:
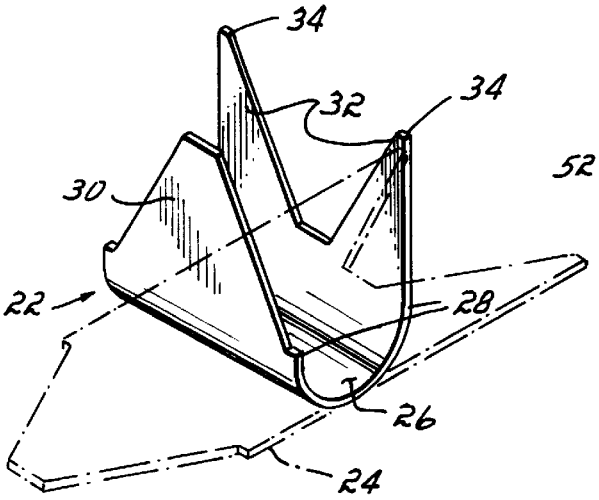
FIG. 2 is a perspective view of a sheet metal clip having single-prong and dual-prong leg portions, also showing the sheet metal blank from which the clip is formed.

With reference to FIG. 2, one embodiment of a sheet metal clip 22 is shown. The sheet metal clip 22 is formed from a blank 24 that is stamped from sheet metal stock. The clip 22 has an arcuate crown portion 26 and leg portions 28 depending from the crown portion 26. The leg portions 28 include a single-prong leg portion 30 and an opposing dual-prong leg portion 32 having prongs 34.

As shown in FIG. 4, when the clip 22 is attached to an upper border wire 18 and an uppermost coil revolution 20, the single-prong portion 30 fits between the prongs 34 of the dual-prong portion 32. One prong 34 is left in an unclamped, open position in order to serve as a barb 36.

Figure 3:
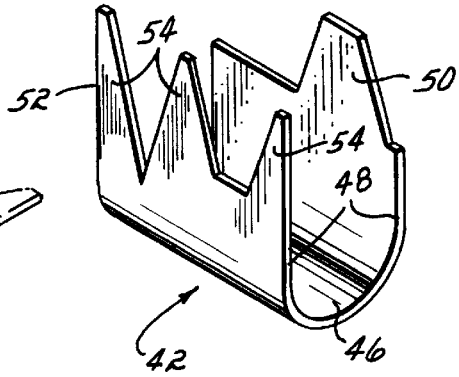
FIG. 3 is a perspective view of a sheet metal clip having single-prong and triple-prong leg portions.

With reference to FIG. 3, an alternative embodiment of a sheet metal clip 42 is shown. The sheet metal clip 42 has an arcuate crown portion 46 and leg portions 48 depending from the crown portion 46. The leg portions 48 include a single-prong portion 50 and an opposing triple-prong portion 52 having prongs 54. One of the prongs 54 is left in an unclamped, open position when the clip 42 is attached to an upper border wire, the open prong thereby serving as a barb 56.

Figure 5A:
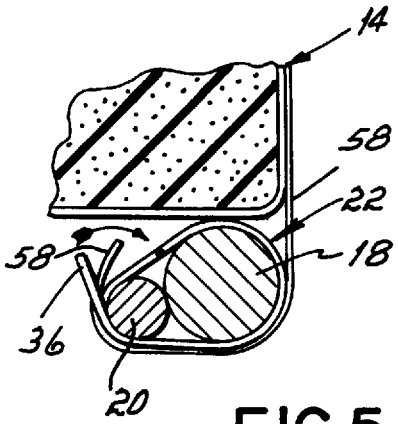
FIG. 5A is an enlarged cross-sectional view showing an edge of a top cover partially wrapped around a border wire and a barb on a sheet metal clip piercing the edge and holding the edge in a taut, partially wrapped position.

With reference to FIG. 5A, the top cover 14 has affixed to it an edge 58. As shown, the top cover 14 is located atop the innerspring core 12 with the edge 58 generally aligned with the upper border wire 18. Each uppermost coil revolution 20 of endmost coil springs 16 is joined to the upper border wire 18 by a sheet metal clip 22 having a barb 36 that in open position, as shown, projects generally inwardly and away from the upper border wire 18. The edge 58 of the top cover 14 is attached to the innerspring core 12 by stretching the edge 58 and wrapping the edge 58 at least partially around the upper border wire 18 and then pushing the edge 58 against each barb 36 so that the barb 36 pierces the edge 58 as shown. The barb 36 acts to hold the edge 58 in a taut position at least partially wrapped around the upper border wire 18. As indicated by the arrow in FIG. 5A, the barb 36 may then be closed by bending it toward the upper border wire 18 so as to sandwich the edge 58 between the barb 36 and the border wire 18 and thereby further aid in holding the edge 58 in place.

Figure 6:
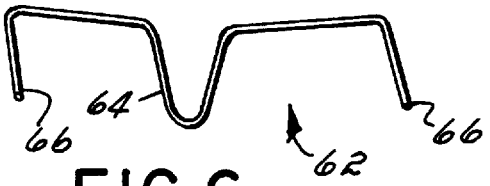
FIG. 6 is a perspective view of a wire clip.
Figure 8:
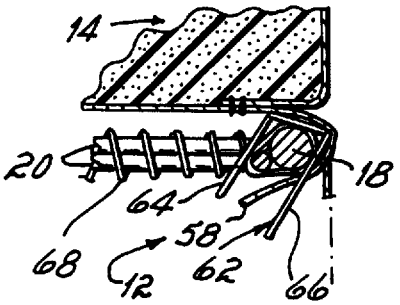
FIG. 8 is a cross-sectional view taken on line 8—8 of FIG. 7 showing an edge of a top cover partially wrapped around a border wire and a barb on a wire clip piercing the edge and holding the edge in a taut, partially wrapped position.

With reference to FIG. 6, an alternative embodiment of a clip 62 is shown. The clip 62 is formed from a length of wire so as to clip onto the upper border wire 18 as shown in FIG. 8. The clip 62 has barbs 66 shaped so as to project generally inwardly and away from the upper border wire 18 when the barbs 66 are in a open position as shown in FIGS. 7 and 8.

As shown in FIG. 8, the barbs 66 pierce the edge 58 of the top cover 14 and hold the edge 58 in a taut position at least partially wrapped around the upper border wire 18. The barbs 66 may be bent into a closed position if desired.

Figure 7:
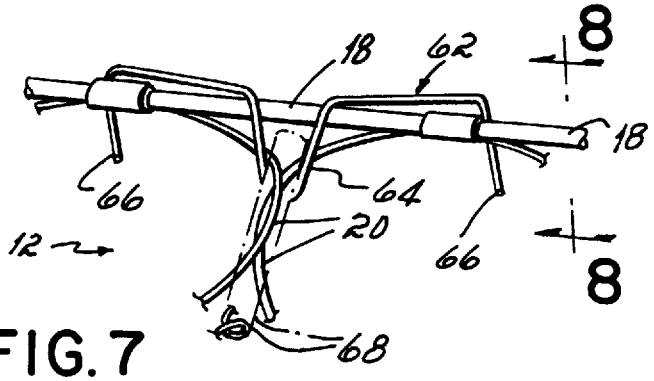
FIG. 7 is a partial perspective view of a wire clip attached to a border wire, showing the ends of the wire clip in open positions and showing the wire clip engaging the coil springs and helical lacing wire.

As shown in FIGS. 7 and 8, the wire clip 62 has a middle portion 64 shaped so as to engage one or more uppermost coil revolutions 20 and/or a helical lacing wire 68 and thereby prevent the clip 62 from sliding along or rotating about the upper border wire 18.

A mattress cover is attached to an innerspring core in accordance with the present invention by first attaching a plurality of clips to an upper border wire of the innerspring core, the clips each having at least one barb that in an open position projects generally inwardly and away from the border wire. A mattress cover is then placed atop the innerspring core with the edges of the cover generally aligned with the upper border wire. The edges of the cover are then stretched downwardly so that they extend down beyond the border wire and are in tension, and while the edges are kept in tension they are wrapped around the border wire and are then pushed against the barbs of the clips such that the barbs at least partially pierce the edges and hold the edges in a taut position at least partially wrapped around the border wire.

It will be appreciated that the present invention thus provides a unique and cost-effective means of securing a top cover of a mattress to an innerspring core. From the above disclosure of the general principles of the invention and the description of the preferred embodiments, those skilled in the art will readily comprehend the various modifications to which the present invention is susceptible. Therefore, we desire to be limited only by the scope of the following claims and equivalents thereof.

We claim:

1. A clip for securing a top cover of a mattress to an innerspring core, said clip comprising a generally U-shaped crown portion and spaced, generally parallel leg portions extending from legs of said U-shaped crown portion, said leg portions comprising a single-prong leg portion and an opposing triple-prong leg portion, said triple-prong leg portion having three prongs at least one of which terminates in a fabric piercing point adapted for piercing an edge surface of said top cover.

2. The clip of claim 1 wherein said U-shaped crown portion is semicircular.

3. A clip for securing a top cover of a mattress to a border wire and a spring coil of an innerspring core, the clip comprising:

a generally U-shaped crown portion, a single-prong leg extension contiguous with one leg of the U-shaped crown portion, and a parallel, dual-prong leg extension contiguous with an opposite leg of the U-shaped crown portion, the dual-prong leg extension having a first prong, and a second prong terminating in a fabric piercing point, whereby upon the clip being applied to the border wire and the spring coil, the single prong leg extension being fully bent around the border wire and the spring coil, the first prong being fully bent around the border wire and the spring coil and the second prong being partially bent around the border wire and the spring coil to form a barb adapted to pierce an edge surface of the top cover.

4. The clip of claim 3 wherein the U-shaped crown portion is semicircular.

5. A clip for securing a top cover of a mattress to a border wire and a spring coil of an innerspring core, the clip comprising:

a generally U-shaped crown portion, a single-prong leg extension contiguous with one leg of the U-shaped crown portion, and a parallel, opposing triple-prong leg extension depending from an opposite leg of the U-shaped crown portion, the triple-prong portion having a first prong, a second prong, and a third prong terminating in a fabric piercing point, whereby upon the clip being applied to the border wire and the spring coil, the single prong leg portion being fully bent around the border wire and the spring coil, the first and second prongs being fully bent around the border wire and the spring coil and the third prong being partially bent around the border wire and the spring coil to form a barb adapted to pierce an edge surface of the top cover.

6. The clip of claim 5 wherein the U-shaped crown portion is semicircular.

7. A method of securing an edge surface of a top cover of a mattress to a border wire and a spring coil of an innerspring core, the method comprising;

locating first and second parallel leg extensions contiguous with opposing legs of a generally U-shaped crown portion of a clip around the border wire and the spring coil;

fully bending a first prong of the first leg extension around the border wire and the spring coil;

fully bending a first prong of the second leg extension around the border wire and the spring coil;

partially bending a second prong of the second leg extension around the border wire and the spring coil to form a barb with an unbent end of the second prong;

stretching the edge surface of the top cover around the border wire and the spring coil; and pushing the edge surface of the top cover over the barb on the end of the second prong, thereby securing the top cover of the mattress with respect to the border wire and spring coil of the innerspring core.

8. The method of claim 7 further comprising step of fully bending the end of the second prong of the second leg extension around border wire and the spring coil to capture and secure a portion of the edge surface of the top cover beneath the end of the second prong.

9. A method of securing an edge surface of a top cover of a mattress to a border wire and a spring coil of an innerspring core, the method comprising:

locating first and second parallel leg portions of a generally U-shaped crown portion of a clip around the border wire and the spring coil;

fully bending a first prong of the first leg portion around the border wire and the spring coil;

fully bending a first prong of the second leg portion around the border wire and the spring coil;

partially bending a second prong of the second leg portion around the border wire and the spring coil to form a barb with an unbent end of the second prong, the unbent end of the second prong forming the barb having a fabric piercing point; and piercing an edge of a top cover stretched around the border wire and the coil spring with the barb, thereby securing the top cover of the mattress with respect to the border wire and spring coil of the innerspring core.

* * * * *